United States Patent [19]

Dobnick

[11] Patent Number: 4,874,990

[45] Date of Patent: Oct. 17, 1989

[54] NOTCH GAP TRANSFORMER AND LIGHTING SYSTEM INCORPORATING SAME

[75] Inventor: Dennis A. Dobnick, Watseka, Ill.

[73] Assignee: QSE Sales & Management, Inc., Watseka, Ill.

[21] Appl. No.: 234,792

[22] Filed: Aug. 22, 1988

[51] Int. Cl.[4] ..... H05B 41/16

[52] U.S. Cl. ..... 315/276; 315/283; 336/178; 336/165

[58] Field of Search ..... 315/276, 278, 279, 338, 315/284, 283, 254, DIG. 4, DIG. 7; 323/308; 336/178, 165

[56] References Cited

U.S. PATENT DOCUMENTS

| | | | |
|---|---|---|---|
| 1,318,787 | 10/1919 | Mollerhoj | 336/178 |
| 1,606,755 | 4/1922 | Field | 29/606 |
| 1,606,761 | 7/1924 | Guilbaud | 336/178 |
| 1,920,818 | 4/1932 | Verrall | 335/225 |
| 2,316,928 | 8/1939 | Woodward | 336/178 |
| 2,400,559 | 11/1942 | Majlinger et al. | 323/362 |
| 2,810,100 | 10/1957 | Strecker | 315/282 |
| 2,830,277 | 6/1953 | Kane | 336/210 |
| 2,988,670 | 6/1961 | Genuit | 336/165 X |
| 3,069,597 | 12/1962 | Feinberg | 336/178 X |
| 3,546,571 | 12/1970 | Fletcher et al. | 336/178 X |
| 3,803,479 | 4/1974 | Rathor | 336/178 |
| 3,820,238 | 6/1974 | Caputo et al. | 29/606 |
| 3,873,910 | 3/1975 | Willis, Jr. | 336/165 X |
| 3,949,268 | 4/1976 | von Mangoldt | 315/254 X |
| 4,484,171 | 11/1984 | McLoughlin | 336/178 X |
| 4,604,552 | 8/1986 | Alley et al. | 315/176 |

FOREIGN PATENT DOCUMENTS

| | | | |
|---|---|---|---|
| 0690959 | 7/1964 | Canada | 336/178 |
| 0033385 | 3/1977 | Japan | 315/276 |
| 0074416 | 4/1985 | Japan | 336/165 |

*Primary Examiner*—Eugene R. LaRoche
*Assistant Examiner*—Seung Ham
*Attorney, Agent, or Firm*—Richard V. Westerhoff

[57] ABSTRACT

The invention is directed to a transformer having notch gaps extending partially across the flux path of the transformer core and having a total gap volume which stores sufficient magnetic energy to substantially eliminate inductive voltage spikes in a clipped sinusoidal waveform applied to the primary of the transformer. As used in a low voltage lighting system in which the intensity of a filament lamp is regulated by a dimmer control which selectively clips the voltage applied to the transformer primary winding by an ac source, the invention substantially eliminates filament ringing.

22 Claims, 2 Drawing Sheets

NOTCH GAP TRANSFORMER AND LIGHTING SYSTEM INCORPORATING SAME

BACKGROUND OF THE INVENTION

1. Field of the Invention

This invention relates to a transformer having notch gaps extending partially across the flux path through the transformer core with a combined gap volume storing sufficient magnetic energy to substantially eliminate inductive spikes induced in the transformer secondary by a clipped sinusoidal voltage applied to the primary. The invention has particular application to apparatus for controlling the intensity of a low voltage lamp with a clipped sinusoidal voltage supplied through a step down transformer incorporating the notch gaps to eliminate filament ringing.

2. Background Information

A popular form of lighting today utilizes low voltage halogen and par (parabolic reflector) lamps. Maximum voltage for these lamps is 12 volts rms which requires a step down transformer for use with commercial power systems. Many of these lamps are controlled with a dimmer to provide a continuously variable level of light intensity. Filament ringing, that is, an audible sound produced by vibration of the filament in the lamp, is a common complaint with such lighting systems. Filament ringing from several lamps in the same room can be quite annoying. It also reduces the life of the lamp.

Filament ringing in these lighting systems can be traced to the inductive kick produced in the transformer voltage in response to the step changes in the clipped sinusoidal voltage supplied to the primary of the transformer by the dimmer circuit. These voltage spikes produce underdamped vibrations in the lamp filament which generate the annoying sound known as filament ringing.

A typical technique for eliminating voltage spikes in inductive circuits is to provide a choke in series with the load. The choke comprises a single winding, usually wound on a laminated core of magnetic material forming a closed flux path. Some chokes used to remove ripple from the output of rectifiers have gaps extending across the full width of the flux path in some of the laminations of the core so that those laminations do not become saturated by the dc current. An example of such a choke, also known as a retardation coil, is disclosed in U.S. Pat. No. 2,400,559. A type of choke known as a swing choke also incorporates gaps extending across the full width of the flux path at one or more locations to provide different values of reluctance at low and high loads.

It is known to provide gaps in at least some laminations of a transformer in order to fine tune the reluctance, since it is difficult to manufacture transformers with exactly the same reluctance. It is also desirable in some instances to provide transformers of the same general configuration but with varying values of reluctance. Gaps provided in the magnetic flux paths of such transformers to tune the reluctance, for the most part, extend across the full width of the flux path. Examples of such transformers can be found in U.S Pat. Nos. 1,606,755 and 1,606,761. Full width gaps are also used in the magnetic circuit of the transformer in U.S. Pat. No. 3,803,479 which is connected in series with a capacitor to form a resonant circuit which regulates the voltage on the secondary.

Gaps which extend the full width of the magnetic circuit significantly reduce the efficiency of a transformer. In addition, the increased current required in the primary to generate a desired secondary current raises the temperature of the transformer which further reduces its efficiency.

There remains, therefore, a need for a transformer which can substantially eliminate voltage spikes in a clipped sinusoidal voltage waveform applied to the primary.

There also remains a need for an efficient, simple means for substantially eliminating filament ringing in a low voltage lighting system energized by a clipped sinusoidal voltage waveform through a step down transformer.

More particularly, there remains a need for such a means in which the functions of stepping down the amplitude of the clipped sinusoidal signal and eliminating the voltage spikes are performed by a single component.

SUMMARY OF THE INVENTION

These and other needs are satisfied by the invention which is directed to a transformer having a transformer core with at least one notch gap extending only partially across the width of the magnetic flux path but having a total gap volume which stores sufficient magnetic energy to delay the propagation time of the switching interval of the clipped sinusoidal voltage by an amount which substantially eliminates inductive spikes in the voltage induced in the secondary winding of the transformer.

Such a notch gapped transformer is particularly suitable for use in the low voltage lighting system in which the intensity of light produced by a filament lamp is controlled by a control circuit in series with an ac source and the primary of the transformer to selectively clip the sinusoidal waveform. By making the total gap volume sufficient to store enough magnetic energy to delay the propagation time of the switching interval of the clipped sinusoidal voltage by an amount which substantially eliminates inductive spikes in the clipped sinusoidal waveform, filament ringing is substantially eliminated.

The notch gaps only extend across the flux path about a distance which leaves sufficient magnetic material to support a magnetic flux adequate to produce full output voltage in the secondary winding under no load conditions. Thus, the notch gaps may extend across between about one third and three fourths of the width of the flux path, and preferably about two thirds. With this arrangement, magnetic energy substantially equivalent to the energy in the voltage spikes is stored in the gaps, yet a sufficiently low reluctance path remains through the core for the transformer to efficiently generate the voltage across the secondary winding.

In a preferred form of the notch gap transformer of the invention, the transformer core is made of a number of laminations each of which includes a center leg, two outer legs and end elements extending across each end of all three legs, with the notch gaps in the center leg around which are wound the primary and secondary windings. Preferably, the notches are adjacent one end of the center leg and adjacent laminations are oppositely oriented so that the notch gaps in adjacent laminations are located at opposite ends of the center leg of the core formed by the laminations. With the laminations formed from at least two sections, one section includes the center leg and the gaps are formed in the free end of the center leg which butts against the one end element forming at least part of a second lamination section. Again, preferably, the lamination sections include an I section comprising the one and element and an E section comprising the three legs and the other end element. Another preferred form of the transformer core is a laminated toroid with aligned gaps cut about one third to about three quarters, but preferably about two thirds, of the way across the toroid.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
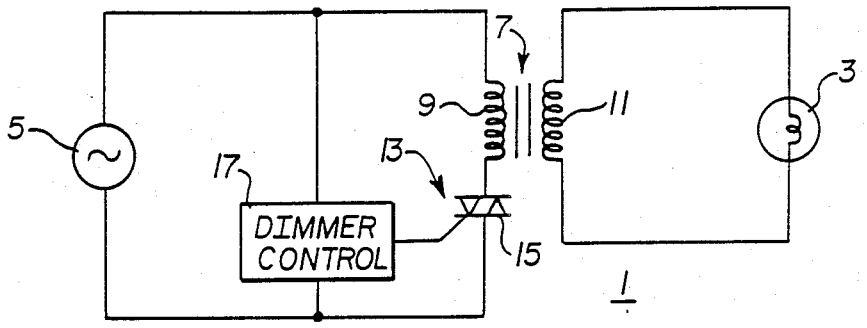
FIG. 1 PRIOR ART
FIG. 1 is a schematic diagram of a low voltage lighting system in accordance with the invention.

A lighting system 1 incorporating the invention is shown schematically in FIG. 1. A low voltage filament lamp 3, such as for example a 12 volt, 50 watt halogen lamp, is energized by a 60 Hertz, 120 volt ac source 5 through a step down transformer 7. The transformer 7 has a primary winding 9 connected to the ac source 5 and a secondary winding 11 connected to the lamp 3 with a 10:1 turns ratio between the windings to reduce the 120 volt supply voltage to the 12 volts required by the lamp. A dimmer circuit 13, which includes a triac 15 connected in series with the primary winding 9 and the ac source 5, selectively clips the sinusoidal voltage waveform provided by the ac source 5 in order to vary the intensity of light produced by the lamp. The firing of the triac 15 is controlled by a dimmer control 17 as is well known in the art.

Figure 2:
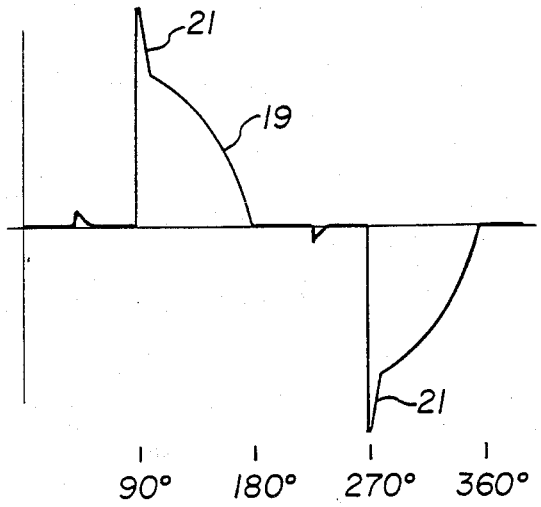
FIG. 2 PRIOR ART
FIG. 2 is a waveform diagram illustrating the inductive spikes formed in a clipped sinusoidal waveform which is generated by a lighting system similar to that shown in FIG. 1 but not incorporating the invention.

A typical clipped sinusoidal voltage waveform generated by the dimmer circuit across the primary winding 9 of the transformer 7 without the invention is shown in FIG. 2. The exemplary waveform 19 is for a 50% duty cycle where the triac 15 is turned on at 90° and 270° to conduct for the last half of each half cycle of the ac voltage waveform generated by the source 5. It will be noticed that the propagation time of the rise in the clipped waveform at 90° and 270° is virtually zero. This step input to the transformer 7 produces a spike or inductive kick 21. It has been determined that these spikes induce undamped vibrations in the filament of the lamp 3 which produce filament ringing. As is evident from FIG. 2, the phenomenon is most pronounced at the 50% duty cycle where the step change in the amplitude of the clipped sinusoidal waveform during each half-cycle is at a maximum.

I have found that by incoporating notch gaps in the core of the transformer 7, the propagation time of the rise in the clipped sinusoidal voltage waveform can be extended to substantially eliminate the spikes 21 and thereby substantially reduce filament ringing.

Figure 3:
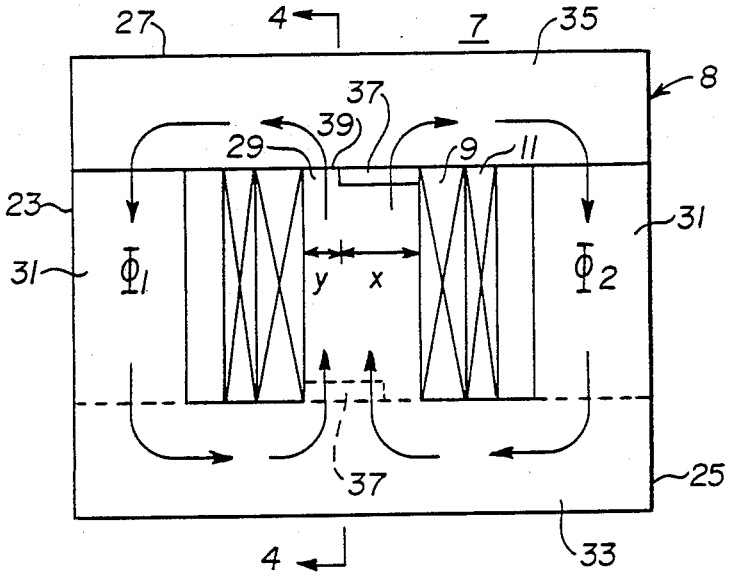
FIG. 3 is a front elevation view of one embodiment of a transformer in accordance with the invention.
Figure 4:
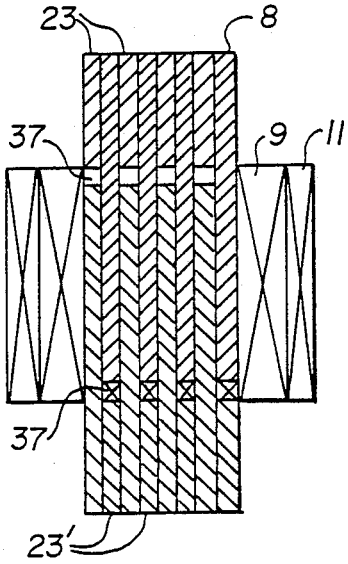
FIG. 4 is a vertical section through the transformer of FIG. 3 taken along the line 4–4.
Figure 5:
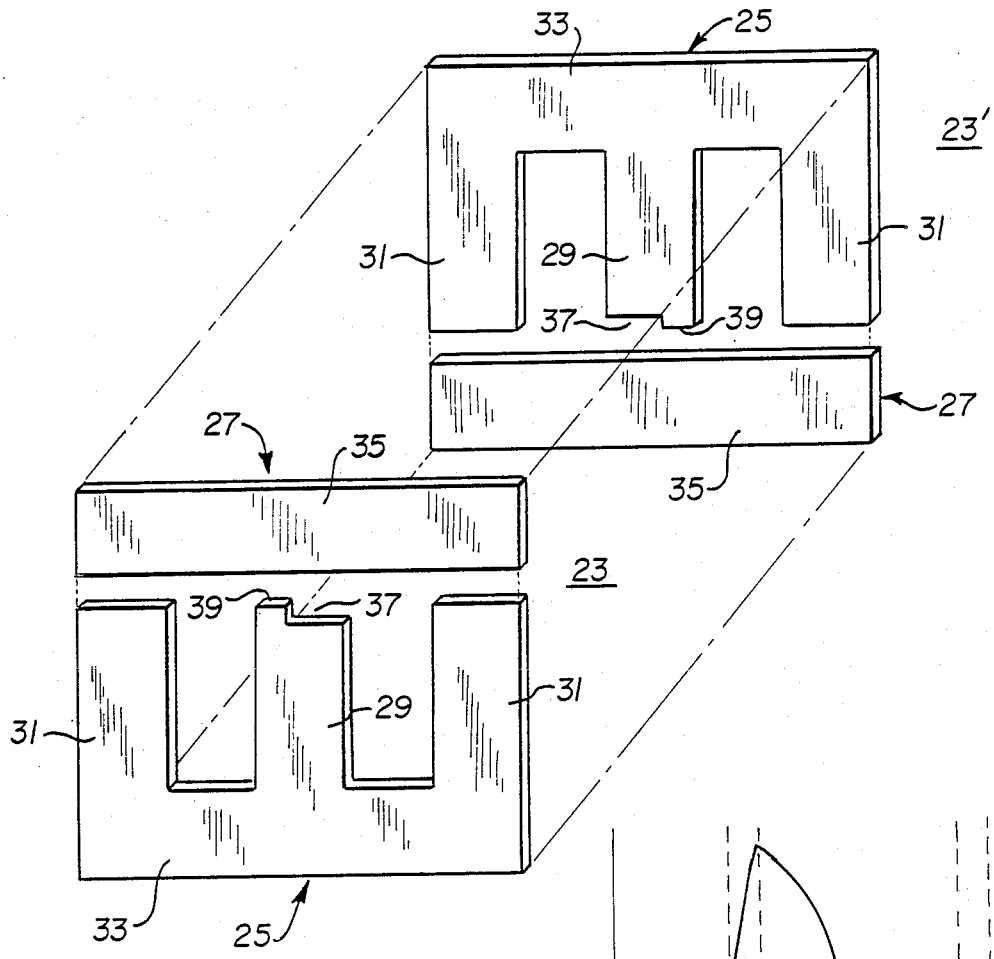
FIG. 5 is an exploded isometric view of two laminations of the transformer shown in FIGS. 3 and 4.

One embodiment of a transformer 7 in accordance with the invention is shown in FIGS. 3 through 5. The core 8 of this transformer is made from a stack of silicone steel laminations 23 each of which comprises an E section 25 and an I section 27. The E section 25 includes a center leg 29, a pair of outer legs 31 and an end element 33 joining the legs in spaced relation. The I section 27 comprises an and element 35 which butts against the free ends of the legs 29 and 31 to form two parallel magnetic circuits for magnetic flux indicated by the arrows.

In alternate laminations 23', the E-section 25 and I section 27 are turned in the opposite direction as best seen in the exploded view of FIG. 5. This configuration is known as a $1\times1$ interleafed arrangement.

Each of the laminations 23 and 23' is coated with an oxide so that adjacent laminations are insulated from one another. Typically, the $1\times1$ interleafed stack of laminations is encapsulated in an epoxy to form a unitary transformer core 8.

The primary winding 9 is wound on the center leg 29 with the secondary winding 11 overlaying the primary winding. Such a transformer described to this point is well known. However, such a transformer configuration, as well as the other prior art transformer designs, produce the inductive spikes which result in filament ringing when used with the circuit of FIG. 1.

In accordance with the invention, notch gaps 37 are cut transversely into the magnetic flux path in the transformer core. These notch gaps 37 extend only partially across the magnetic flux path. The notch gaps 37 may be left open and thus filled with air, or may be filled with a non-magnetic material such as an epoxy. In the preferred form of the invention as applied to the E-I laminated transformer 7 of FIGS. 3 through 5, the notch gaps 37 are cut out of the free ends 39 of the center legs 29 of the E sections 25 of each lamination 23, 23'. Thus, the notch gaps 37, which are bounded by the free end 39 of the center leg 29 and the end element 35 which butts against it are at opposite ends of the center leg 29 in adjacent laminations. This is the result of a manufacturing expedient, and it is not necessary that the notch gaps 37 be out of register in adjacent laminations.

The important criteria for forming the notch gaps 37 are that the total volume of these gaps be such as to be capable of storing sufficient magnetic energy to substantially eliminate the inductive spikes 21 illustrated in FIG. 2, and that they only extend partially across the magnetic flux path through the transformer core.

The amount of magnetic energy storage needed to eliminate the inductive spikes can be determined empirically by measuring the area under the spike 21 shown in FIG. 2 as generated on an oscilloscope and multiplying by the current drawn from the transformer secondary. Since the transformer is driven hard, the phase angle between the current and voltage is negligible and can be ignored for the purpose of determining the amount of magnetic energy storage needed.

The energy which can be stored in the notch gaps 37 in the transformer core is determined by the following equation:

$$\text{Energy (joules)} = \frac{\Delta B^2 \times m^3 \times 10^6}{2\mu_{eff}} \quad \text{Eq.(1)}$$

Where $\Delta B^2$ equals the square of the ac flux density which can be supported by the material from which the transformer core laminations are made and is available from the manufacturer, $m^3$ is the total volume of air in the notch gaps in the transformer core, and $\mu_{eff}$ is the effective magnetic permeability of the flux path through the core which includes the notch gaps.

As indicated in FIG. 3, the total flux $\Phi_T$ in each lamination 23 of the transformer core 8 can be divided into two components, $\Phi_1$ which is the flux through one end leg 31 and the portion of the center eg 29 not interrupted by the notch gap 37, and $\Phi_2$ which is the flux through the other end leg 31, the notch gap 37 and the remaining portion of the center leg 29.

Determination of the notch gap dimensions is an iterative process in which the length, lg, of the notch gap 37 is presumed and a value of $\mu_{eff}$ is derived from the formula:

$$\mu_{eff} = \frac{lm \times \mu_o}{lm + (\mu_o \times lg)} \quad \text{(Eq. 2)}$$

where lm is the length of the path of the flux $\Phi_2$ through the magnetic core material, and $\mu_o$ is the magnetic permeability of the core material. The permeability $\mu_o$ is expressed in cgs units under which the permeability of air in the notch gaps 37 is one.

The empirically determined energy in the spike 21 and $\mu_{eff}$ calculated from equation 2 are inserted into equation 1 which may then be solved for, $m^3$, the total notch gap volume required. This total volume is divided by the numbers of laminations, n, to determine the notch gap volume per lamination. Since the thickness of the lamination is known, and the gap length, lg, was presumed, the width, x, or depth that the notch gap 37 extends into the center leg 29 of the transformer core can be determined.

The calculated width, x, of the notch gaps is then used to determine the width, y, of the center lg 29 remaining adjacent the notch gap 37 for the flux $\phi_1$. This width y should be sufficient to support a flux $\Phi_1$ adequate to produce full output voltage in the secondary winding 11 of the transformer under no load conditions. With the width y much less than this value, the transformer is very inefficient in that flux must be established through the notch gaps 37 to generate full output voltage. With the width y much larger than the value required to support full voltage under no load conditions, spikes begin to appear in the secondary voltage in response to a clipped sinusoidaal voltage applied to the primary. At the prescribed value of y, and therefore x, the energy, which without the notches would generate the spike, is instead stored as magnetic energy in the notch gaps 37.

Figure 6:
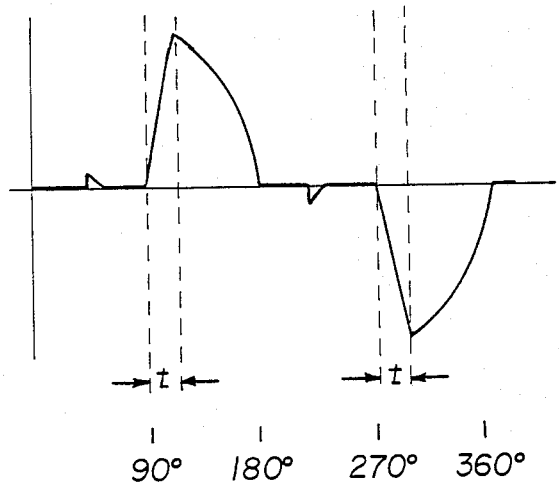
FIG. 6 is a waveform diagram illustrating how the invention delays the propagation time of the switching interval of a clipped sinusoidal waveform by an amount which illuminates spikes in the secondary voltage.

If the initial value of y does not meet the above criteria, the assumed value of lg is adjusted and new values of $\mu_{eff}$, $m^3$, x and y are determined. This process is repeated until the value of y assumes an acceptable value within the above criteria. I have found that the depth of the notches across the laminations should in general be between about $\frac{1}{3}$ and $\frac{3}{4}$ of the width of the core at the notch gap, and preferably about $\frac{2}{3}$. However, the operative characteristic is that the remaining width of the core at the notch should be about that required to support full output voltage at no load conditions. As energy above that level is applied to the primary of the transformer, the constricted portion of the magnetic flux path through the core adjacent the notch gap saturates, and additional energy applied to the primary winding is stored in the notch gaps delaying the duration of the switching interval of the clipped sinusoidal voltage waveform by an amount which substantially eliminates spikes in the voltage waveform produced on the secondary winding of the transformer. This effect is illustrated in FIG. 6.

The notch gaps 37 do not have to be formed in the center leg 29 of the transformer 7. They can be formed in the end legs 31 or the end elements 33 or 35 or in any combination of these locations. As mentioned previously, it is not necessary that the gaps 37 be out of registration in adjacent laminations. They could be all aligned to form a gap straight through a selected portion of the flux path through the transformer core. In fact, if the E and I lamination sections 25 and 27 are butt stacked, that is with all the E sections aligned, and all the I sections aligned, and the gaps are cut in the free ends 39 as in the exemplary laminations of the center legs 29, all of the gaps would be in register with one another.

Figure 7:
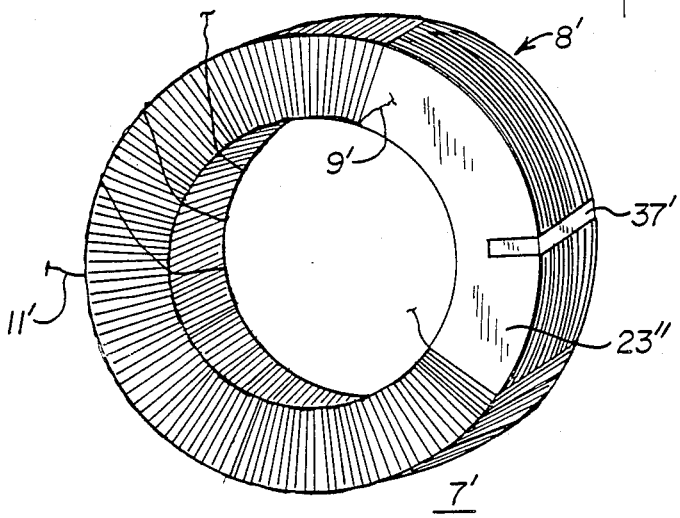
FIG. 7 is an isometric view of another embodiment of a transformer in accordance with the invention.

Clearly, the invention can be applied to transformer laminations sectioned in other configurations such as C-T and F-L sections. It can also be applied to transformers with other flux path configurations. For example, FIG. 7 illustrates application of the invention to a transformer 7' with a toroidal core 8' made of a number of flat ring-shaped laminations 23''. The notch gaps 37' may be formed in the core 8' by sawing partially through the component laminations 23'' after they have been assembled. Again the total volume of the notch gaps 37' is selected to be sufficient to store magnetic energy equivalent to the energy in the spike 21 that would be produced by a 50% duty cycle clipped sinusoidal waveform without the notch gaps 37'. The notch gaps 37' should extend no more than about three fourths and preferably about two thirds of the way across the flux path defined by the core 8', but in any event about a distance which is sufficient that the remaining portion of the core is adequate to support full output voltage under no load conditions. The notch gaps 37' can be filled with an epoxy. The primary winding 9' is would all the way around the toroidal core 8' with the secondary winding 11' wound over it.

As can be appreciated from the above description and the drawings, the present invention provides an efficient single component device for eliminating filament ringing in low voltage filament lamps powered by a clipped sinusoidal voltage. It clearly has use also in other applications where it is desired to substantially eliminate voltage spikes in the secondary of a transformer energized by a clipped sinusoidal source.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A lighting system powered by an ac source producing a sinusoidal voltage waveform, said system comprising a filament lamp, a transformer having a primary winding connected to the ac source and a secondary winding connected to the filament lamp, and a control circuit connected in series with the ac source and the primary winding of the transformer which selectively clips with a substantially zero switching interval the sinusoidal voltage waveform applied to the primary winding of the transformer by the ac source to control the intensity of light produced by the lamp, said transformer having a core of magnetic material upon which said primary and secondary windings are wound and defining a magnetic flux path, and at least one notch gap extending only partially across said magnetic flux path, said at least one notch gap having a volume storing sufficient magnetic energy to delay the duration of the switching interval of the clipped sinusoidal voltage waveform by an amount which substantially eliminates inductive spikes in said clipped sinusoidal voltage waveform to thereby substantially reduce filament ringing.

2. The apparatus of claim 1 wherein said at least one notch gap extends across the flux path about a distance which leaves sufficient magnetic material to support a magnetic flux adequate to produce full output voltage in the secondary winding under no load conditions.

3. The apparatus of claim 1 wherein said at least one notch gap extends across between about one third and about three fourths of the width of the flux path.

4. The apparatus of claim 3 wherein said at least one notch gap extends across about two thirds of the width of the flux path.

5. The apparatus of claim 1 wherein said transformer core comprises a stack of laminations with at least some of said laminations having notch gaps extending partially across the flux path and with the notch gaps having a total volume storing sufficient magnetic energy to delay the duration of the switching interval of the clipped sinusoidal voltage waveform by an amount which substantially eliminates inductive spikes in said clipped sinusoidal voltage waveform to thereby substantially reduce filament ringing.

6. The apparatus of claim 5 wherein said laminations form a core with a center leg and two outer legs and end elements extending across each end of all three legs, and wherein said primary and secondary coils are wound on said center leg.

7. The apparatus of claim 6 wherein said notch gaps are in said center leg of said laminations.

8. The apparatus of claim 7 wherein said notch gaps are adjacent one end of said center leg of said laminations and wherein adjacent laminations are oriented oppositely such that the notch gaps in adjacent laminations are located at opposite ends of the center leg of the core formed by the laminations.

9. The apparatus of claim 8 wherein each lamination is formed from at least two sections with one section including said center leg having a free end and another section including one of said end elements, and wherein said center leg has a notch extending inward from one side edge at the free end adjacent said one element such that said free end of said center leg butts against said one end element with said notch forming said notch gap.

10. The apparatus of claim 9 wherein said laminations include an I section comprising said one end element and an E section comprising the three legs and the other end element.

11. The apparatus of claim 10 wherein said notch in the free end of said center leg extends across from about one third to about three fourths of the width of said center leg.

12. The apparatus of claim 11 wherein said notch in the free end of said center leg extends across about two thirds of the width of said center leg.

13. The apparatus of claim 10 wherein said notch in the free end of said center leg extends across the width of the center leg about a distance which leaves sufficient magnetic material to support a magnetic flux adequate to produce full output voltage on the secondary winding under no load conditions.

14. The apparatus of claim 5 wherein said laminations form a toroidal transformer core and said notch gaps extend partially across the width of the toroidal transformer core.

15. The apparatus of claim 14 wherein said notch gaps are aligned in registration across the laminations of said toroidal transformer core.

16. A notch gap transformer adapted to change the amplitude of a clipped sinusoidal voltage waveform having substantially a zero switching interval substantially without inductive spikes, said transformer comprising a transformer core of magnetic material defining a magnetic flux path, a primary winding wound on said transformer core to which said clipped sinusoidal voltage waveform is applied and a secondary winding also wound on said transformer core, said transformer core having at least one notch gap extending only partially across the width of the flux path about a distance which leaves sufficient magnetic material to support a magnetic flux adequate to produce full output voltage in the secondary winding under no load conditions, said at least one notch gap having a volume to store sufficient magnetic energy to delay the duration of the switching interval of the clipped sinusoidal voltage waveform by an amount which substantially reduces inductive spikes in said clipped sinusoidal voltage waveform.

17. The notch gap transformer of claim 16 in which said transformer core comprises a stack of laminations with at least some of said laminations having notch gaps extending partially across the width of the flux path and with the notch gaps having a total volume to store sufficient magnetic energy to delay the duration of the switching interval of the clipped sinusoidal voltage waveform by an amount which substantially reduces inductive spikes in said clipped sinusoidal voltage waveform.

18. The notch gap transformer of claim 17 in which said notch gaps extend between about one third and about three fourth across the width of the flux path formed by said transformer core.

19. The notch gap transformer of claim 18 in which said notch gaps extend about two thirds across the width of the flux path formed by said transformer core.

20. A notch gap transformer for use in changing the amplitude of a clipped sinusoidal voltage waveform having a substantially zero switching interval substantially without inductive spikes, comprising a stack of laminations forming a transformer core having a center leg, two outer legs and end elements extending across each end of all three legs, a primary winding to which said clipped sinusoidal waveform is applied wound on said center leg and a secondary winding also wound on said center leg, said center legs of at least some of said laminations having a notch forming a notch gap in a side edge extending only partially across the width of the center leg about a distance which leaves sufficient magnetic material to support a magnetic flux adequate to produce full output voltage in the secondary winding under no load conditions, said center legs of said laminations being notch gapped with a total volume storing sufficient magnetic energy to delay the duration of the switching interval of the clipped sinusoidal voltage waveform by an amount which substantially eliminates inductive spikes in said clipped sinusoidal voltage waveform to thereby substantially reduce filament ringing.

21. The notch gap transformer of claim 2 wherein said laminations are formed in at least two sections with one section including said center leg having a free end and another section including one of said end elements and wherein said center leg has a notch extending from the free end and partially across the width of said center leg adjacent said one end element of said other section such that said free end of said center leg butts against said one end element with said notch forming said notch gap.

22. The notch gap transformer of claim 21 wherein said sections of adjacent laminations of said transformer core are oppositely directed such that said notch gaps in adjacent laminations are at opposite ends of the center lag of the transformer core.

* * * * *

UNITED STATES PATENT AND TRADEMARK OFFICE

CERTIFICATE OF CORRECTION

PATENT NO. : 4,874,990

DATED : October 17, 1989

INVENTOR(S) : DENNIS A. DOBNICK

It is certified that error appears in the above-identified patent and that said Letters Patent is hereby corrected as shown below:

Column 3, line 5, the first occurrence of "and" should be --end--.

Column 4, line 15, "and" should be --end--.

Column 5, line 15, "eg" should be --leg--.

Column 5, line 54, "sinusoidaal" should be --sinusoidal--.

Column 6, line 47, "would" should be --wound--.

Claim 21, column 9, line 11, "2" should be --20--.

Claim 22, column 10, line 12, "lag" should be --leg--.

Signed and Sealed this

Ninth Day of August, 199

Attest:

Bruce Lehman

BRUCE LEHMAN

Attesting Officer

Commissioner of Patents and Trademarks